US007770648B2

(12) United States Patent
Anderson

(10) Patent No.: US 7,770,648 B2
(45) Date of Patent: Aug. 10, 2010

(54) COMPLETION METHOD FOR WELL CLEANUP AND ZONE ISOLATION

(75) Inventor: Neil A. Anderson, Insch (GB)

(73) Assignee: Baker Hughes Incorporated, Houston, TX (US)

( * ) Notice: Subject to any disclaimer, the term of this patent is extended or adjusted under 35 U.S.C. 154(b) by 167 days.

(21) Appl. No.: 11/687,018

(22) Filed: Mar. 16, 2007

(65) Prior Publication Data

US 2008/0223580 A1 Sep. 18, 2008

(51) Int. Cl.
*E21B 37/02* (2006.01)
*E21B 37/08* (2006.01)

(52) U.S. Cl. ..... 166/311; 166/312

(58) Field of Classification Search ..... 166/276, 166/278, 311, 56, 312
See application file for complete search history.

(56) References Cited

U.S. PATENT DOCUMENTS 5,555,945 A * 9/1996 Schultz et al. ..... 175/50
6,236,620 B1 * 5/2001 Schultz et al. ..... 367/82
6,250,387 B1 * 6/2001 Carmichael et al. ..... 166/311
7,451,819 B2 * 11/2008 Chang et al. ..... 166/299
2002/0020535 A1 * 2/2002 Johnson et al. ..... 166/363
2005/0072571 A1 * 4/2005 Penisson ..... 166/311
2006/0131029 A1 * 6/2006 Zupanick ..... 166/370

* cited by examiner

*Primary Examiner*—David J Bagnell
*Assistant Examiner*—Brad Harcourt
(74) *Attorney, Agent, or Firm*—Steve Rosenblatt

(57) ABSTRACT

A completion method isolates a lower zone while circulation at high rates takes place above to clean debris out of the wellbore. Pressure fluctuation sensitive equipment in a lower completion is isolated with a tubing valve during circulation. This further prevents debris from clogging inlet pressure passages to equipment below the isolation valve during circulation to get the debris out. After circulation the packer is unset and the tubing valve is opened and a wellbore filter tool directs well fluids through a screen and captures the debris as the string is pulled toward the surface.

20 Claims, 1 Drawing Sheet

COMPLETION METHOD FOR WELL CLEANUP AND ZONE ISOLATION

FIELD OF THE INVENTION

The field of the invention relates to well cleanup operations that are done in wellbores where fluid loss is an issue, or pressure sensitive equipment requires isolating.

BACKGROUND OF THE INVENTION

Wellbore operations at times require displacement of mud used in drilling with completion fluids. Additionally, the wellbore needs to be cleaned up to remove debris such as mud residue or cuttings that may remain in the wellbore. Tools such as casing scrapers and downhole filters are used for such operations. In addition, circulation at high rates can be used to not only displace the drilling mud but to also get some of the debris out of the well before trying to filter the remaining debris by, for example using tools with cup seals against the casing wall so that the well fluids are directed into a filtering tool with a screen and a debris retention volume which fills as the cleanup tool is moved out of the hole with the bottom hole assembly.

What happens at high circulation rates during fluid displacement operations is that the density varies to such an extent that wide pressure fluctuations can occur in the wellbore and in the tubing string. To the extent there are valves or other equipment that are sensitive to pressure application and removal cycles for their operation, the result can be a premature operation of downhole equipment. Another issue, when it is desired to use very high circulation rates, is that the resistance to flow increases and the operating pressure increases to get the desired flow rates. In some situations there is an exposed open hole or a formation where extensive fluid losses can occur. This cost the operator money in several ways. One is the cost of the fluid lost and another is the subsequent productivity loss from the formation that comes about from fluid loss. The higher circulation rates that bring about an increase in pressure to accomplish them also have a tendency to propel solids in the circulated fluid into small passages that are used to operate components in the bottom hole assembly and thus heighten the possibility that such equipment will not work when it is later needed for other operations. One compromise in the past has been to keep circulation rates low with the hope that the circulation pressure will be minimized but this has the undesirable effect of undermining the effectiveness of circulation as a well cleanup operation while still leaving the risks of fluid loss and equipment malfunction.

The present invention deals with these issues while providing an effective way to clean up the well. The zone that may take on fluids due to high circulation rates during wellbore cleanup is isolated with a packer. Lower portions of the completion whose operating systems may clog with debris due to high circulation pressures of debris laden mud are isolated in the tubing string during circulation. After circulation at the desired rates is concluded, the packer is unset and the string is pulled to allow a well filtering tool to capture the remaining debris in the annulus. The string is then repositioned and the tubing valve is opened to allow further downhole operations to take place. These and other aspects of the present invention will be more readily apparent to those skilled in the art from a review of the description of the preferred embodiment and the associated drawing with the understanding that the claims define the full scope of the invention.

SUMMARY OF THE INVENTION

A completion method isolates a lower zone while circulation at high rates takes place above to clean debris out of the wellbore. Pressure fluctuation sensitive equipment in a lower completion is isolated with a tubing valve during circulation. This further prevents debris from clogging inlet pressure passages to equipment below the isolation valve during circulation to get the debris out. After circulation the packer is unset and the tubing valve is opened and a wellbore filter tool directs well fluids through a screen and captures the debris as the string is pulled toward the surface.

DETAILED DESCRIPTION OF THE PREFERRED EMBODIMENT

Figure 1:
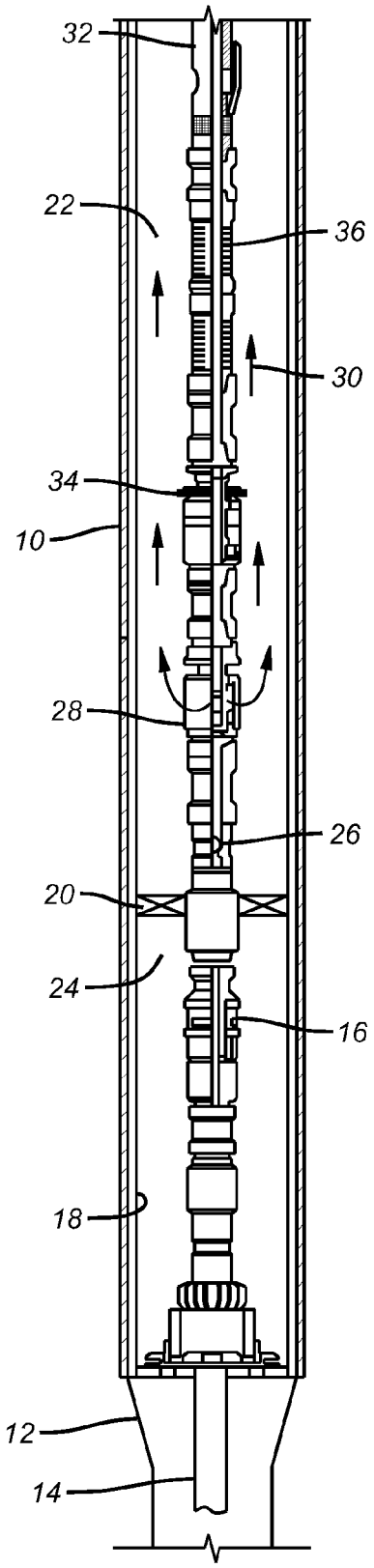
FIG. 1 is a section view of an assembly that can be used to practice the method.
Figure 2:
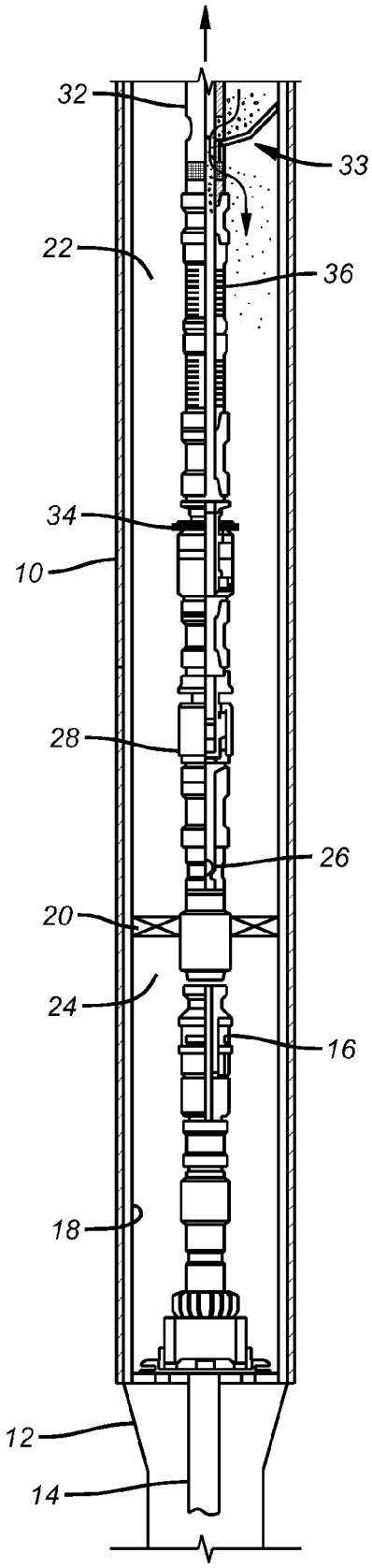
FIG. 2 is a view showing the assembly capturing debris with a filter assembly and diverter as it pulled out of the hole.

FIG. 1 shows a casing 10 leading to an open hole 12 below. A tubular 14 extends to a bottom hole assembly, not shown, that is disposed in the open hole 12. A casing scraper 16 removes debris from inner wall 18 of the casing 12 on the way into the hole. An isolation packer 20 isolates annular space 22 from annular space 24 when set as shown in the FIG. 1. An inline valve 26 closes off the passage through the packer 20. Above the packer, a circulation sub that can also have a swivel feature 28 is shown in the open position so that flow in a circulation path, indicated by arrows 30 can be undertaken to circulate out debris at high circulation rates and the pressure needed to achieve them while isolating the open hole with packer 20 set in the annulus and an isolation valve 26 set in the tubing string. After the circulation has gone on long enough to replace the drilling fluid and to remove the debris the circulation sub 28 is closed, the valve 26 is opened and the packer 20 is unset and the string 32 is pulled. That allows the wellbore cleanup tool to direct annular well fluid into itself where it can be filtered and the solids retained. Other types of well cleanup tools can also be used without departing from the invention. Additionally magnetic pickup tools 36 can be added to the string as shown in FIG. 1.

As a result of this method, involving a unique assembly of principally known components, the increased and/or variable pressures that result from fluid replacement and high circulation rates involved in the method do not create fluid losses or formation damage of the sensitive open hole 12. Additionally, with valve 26 isolating pressure actuated equipment located below, the chances of such equipment refusing to respond to pressure signals due to lines clogged with well debris packed in small passages by high circulation pressures is also reduced because those high pressures are isolated from such equipment by valve 26. The valve 26 can be a variety of styles such as a sliding sleeve or have an obstructing member that can be moved to a wider portion in a passage to allow selective opening or any other style.

While the assembly of the equipment can vary, the following themes in combination or in the alternative are common. Wellbore cleanup is undertaken with a sensitive zone isolated. Wellbore cleanup is undertaken, with equipment in communication with the tubing string whose operation can be impaired with debris under higher pressures from high circulation rates, isolated from the circulation flow path. Well cleanup occurs by high circulation or optionally reverse circulation rates that cause a pressure rise and or fluctuation. Equipment that can be inadvertently actuated with pressure variations of fairly low magnitudes, such as under about 300 PSIG, is not inadvertently operated. Well fluids are replaced in shorter times. Well cleanup is more effective with a combination of circulation and a well filter tool schematically illustrated as 33 that operates with the string being pulled out of the hole or in other known ways. The annular and tubing closures can be released for the operation of the wellbore filter tool and to avoid pulling a wet string.

The above description is illustrative of the preferred embodiment and many modifications may be made by those skilled in the art without departing from the invention whose scope is to be determined from the literal and equivalent scope of the claims below:

I claim:

1. A downhole completion method, comprising:

inserting a string into a tubular having an internal wall defining the wellbore;

initially dislodging debris from said internal wall with a scraper tool when inserting said string;

closing off the string internally and externally in said wellbore after said initial debris dislodging;

isolating, by said closing off, a first portion of a wellbore from a second portion leaving said initially dislodged debris in one of said portions;

performing a debris cleanup of said previously dislodged debris from said internal wall in the first portion, through at least one wall opening in said string with the second zone isolated.

2. The method of claim 1, comprising:

using circulation in said first zone as said debris cleanup.

3. The method of claim 1, comprising:

providing a port in a tubing string; and circulating through said port into the annulus around said string in said first zone for debris cleanup.

4. The method of claim 3, comprising:

providing isolation between said zones so as to locate said port in said first zone.

5. The method of claim 4, comprising:

using a packer to isolate said zones.

6. The method of claim 5, comprising:

extending said string into said second zone beyond said packer.

7. The method of claim 6, comprising:

using a valve to selectively isolate equipment in fluid communication with said string and located in said second zone.

8. The method of claim 3, comprising:

extending said string into both said zones;

providing selective isolation in at least one of an annular space around said string and within said string before debris cleanup begins.

9. The method of claim 8, comprising:

performing debris cleanup with said isolation in place within and around said string.

10. The method of claim 9, comprising:

using circulation though a circulation sub as said debris cleanup.

11. The method of claim 1, comprising:

locating said first zone uphole of said second zone.

12. The method of claim 11, comprising:

providing casing the length of said first zone.

13. The method of claim 12, comprising:

providing an open hole for at least a portion of said second zone.

14. The method of claim 13, comprising:

using circulation or reverse circulation to clean debris from casing in said first zone.

15. A downhole completion method, comprising:

inserting a string into a tubular defining the wellbore;

initially dislodging debris from the tubular when inserting said string;

closing off the string internally and externally in said wellbore after said initial debris dislodging;

isolating, by said closing off, a first portion of a wellbore from a second portion leaving said initially dislodged debris in one of said portions;

performing a debris cleanup of said previously dislodged debris from the tubular in the first portion, through at least one wall opening in said string with the second zone isolated;

providing a port in a tubing string; and circulating through said port into the annulus around said string in said first zone for debris cleanup;

extending said string into both said zones;

providing selective isolation in at least one of an annular space around said string and within said string before debris cleanup begins;

performing debris cleanup with said isolation in place within and around said string;

using circulation though a circulation sub as said debris cleanup;

filtering well fluids as said debris cleanup.

16. The method of claim 15, comprising:

removing isolation within and around said string before said filtering.

17. The method of claim 16, comprising:

lifting said string to perform said filtering.

18. A downhole completion method, comprising:

inserting a string into a tubular defining the wellbore;

initially dislodging debris from the tubular when inserting said string;

closing off the string internally and externally in said wellbore after said initial debris dislodging;

isolating, by said closing off, a first portion of a wellbore from a second portion leaving said initially dislodged debris in one of said portions;

performing a debris cleanup of said previously dislodged debris from the tubular in the first portion, through at least one wall opening in said string with the second zone isolated;

providing a port in a tubing string; and circulating through said port into the annulus around said string in said first zone for debris cleanup;

providing isolation between said zones so as to locate said port in said first zone;

using a packer to isolate said zones;

extending said string into said second zone beyond said packer;

using a valve to selectively isolate equipment in fluid communication with said string and located in said second zone;

unsetting the packer after said circulating;

opening said valve in said string; and operating a well fluid filter to remove remaining debris after said circulating.

19. The method of claim 18, comprising:

operating said filter by lifting said string.

20. The method of claim 19, comprising:

using at least one of a magnetic sub and a casing scraper on said string.

* * * * *